US010399101B1

(12) United States Patent
Montileone et al.

(10) Patent No.: US 10,399,101 B1
(45) Date of Patent: Sep. 3, 2019

(54) CONTAINER WITH DETACHABLE BOTTOM AND DISPENSER

(71) Applicants: Karen Montileone, St Louis, MO (US); Steven Montileone, St Louis, MO (US)

(72) Inventors: Karen Montileone, St Louis, MO (US); Steven Montileone, St Louis, MO (US)

( * ) Notice: Subject to any disclaimer, the term of this patent is extended or adjusted under 35 U.S.C. 154(b) by 0 days.

(21) Appl. No.: 15/867,237

(22) Filed: Jan. 10, 2018

Related U.S. Application Data

(60) Provisional application No. 62/444,407, filed on Jan. 10, 2017.

(51) Int. Cl.
*B05B 11/00* (2006.01)
*B05B 15/30* (2018.01)
*B65D 75/58* (2006.01)

(52) U.S. Cl.
CPC ..... *B05B 11/0037* (2013.01); *B05B 11/30* (2013.01); *B05B 15/30* (2018.02); *B65D 75/5827* (2013.01)

(58) Field of Classification Search
CPC ..... B05B 11/30; B05B 11/0037; B05B 15/30
USPC ..... 222/189.1, 321.7, 342, 382; 220/695, 220/703–710
See application file for complete search history.

(56) References Cited

U.S. PATENT DOCUMENTS

| | | | | |
|---|---|---|---|---|
| D376,979 | S | 12/1996 | Davidson, III | |
| 5,636,770 | A * | 6/1997 | Hachinohe | B65D 83/32 222/402.1 |
| 6,123,234 | A * | 9/2000 | Lai | B05B 11/0005 222/321.7 |
| 6,223,939 | B1 * | 5/2001 | Bitton | B05B 11/0005 222/78 |
| 6,279,778 | B1 * | 8/2001 | Ho | B05B 11/0005 222/321.7 |
| 8,186,391 | B2 | 5/2012 | Wilson | |
| 8,376,192 | B2 * | 2/2013 | Maddy | B05B 15/30 222/382 |
| 9,259,751 | B2 * | 2/2016 | Crawford | B05B 11/0037 |
| 2011/0011822 | A1 | 1/2011 | Moore | |
| 2011/0011895 | A1 * | 1/2011 | Michitsuji | B05B 11/3001 222/382 |
| 2011/0076362 | A1 | 3/2011 | Holtrop | |
| 2011/0309083 | A1 | 12/2011 | Charlene | |
| 2012/0175382 | A1 | 7/2012 | McAuley-Davis et al. | |
| 2013/0037557 | A1 | 2/2013 | Ting | |
| 2013/0098944 | A1 | 4/2013 | Broadney | |
| 2014/0319182 | A1 * | 10/2014 | Anzalone | B05B 11/3042 222/382 |
| 2015/0321209 | A1 * | 11/2015 | Brickler | A45D 34/00 222/382 |

* cited by examiner

*Primary Examiner* — Vishal Pancholi
(74) *Attorney, Agent, or Firm* — Cramer Patent & Design, PLLC; Aaron R. Cramer

(57) ABSTRACT

A container includes a detachable bottom and a liquid dispensing hand pump. A lid is provided which secures over the open surface of the bottom when removed from the container upper portion. When not in use, the lid secures to the base of the removable bottom.

14 Claims, 5 Drawing Sheets

CONTAINER WITH DETACHABLE BOTTOM AND DISPENSER

RELATED APPLICATIONS

The present invention was first described in and claims the benefit of U.S. Provisional Patent Application No. 62/444,407 filed on Jan. 10, 2017, the entire disclosures of which are incorporated herein by reference.

FIELD OF THE INVENTION

The invention relates generally to a container with a detachable bottom and a dispensing hand pump.

BACKGROUND OF THE INVENTION

There are a wide variety of viscous liquid products that come in hand pump containers. They range from personal care products such as shampoo, conditioner, and hand cream, commercial and industrial products such as wax, lubricants, and cleaning products. And even food products such as condiments. However, one (1) thing that all such products have in common is that not all of the contained product can be removed by the hand pump. Depending on the viscosity of the contained compound, up to twenty percent (20%) of the product may remain inaccessible. This forces the user to resort to other methods such as slamming the bottle on a hard surface, turning it upside down to drain into another container, or the like. Even after such approaches, some of the product is still likely to remain. In order to get all of the product, many users resort to cutting the container open and using a spatula like object to scrape the sides and bottom. While such an approach grants access to all of the product, it destroys the integrity of the container, forcing users to transfer the product to another container and find a spatula, neither of which is not always readily available or suited for the task at hand. Accordingly, there exists a need for a means by all products dispensed in hand pump containers can be easily accessed and completely consumed in a manner which addresses the above-mentioned disadvantages. The development of the separable hand pump apparatus for viscous liquids fulfills this need.

SUMMARY OF THE INVENTION

In view of the foregoing disadvantages inherent in the prior art, it has been observed that there is need of a separable container that enables a user to "breakaway" an upper half thereof when the contents within the container have gravitated towards a lower half in order to best access the contents therein.

To achieve the above and other objectives, the present invention provides for such a container to include the upper half having an upper sidewall, an open bottom, and an open top, a lower half having an upper end conjoined to a lower end of said upper container half with a fastening strip, a lower sidewall, and a lower bottom wall. A lid assembly is removably attached to a lower end of said lower half, and also capable of attaching the upper end of the lower half when the fastening strip removes the upper half from the lower half. A hand pump mechanism is removably attachable to said open top. Operation of the hand pump mechanism dispenses contents held within the container. Removal of the fastening strip severs the upper half from said lower half.

In certain embodiments, the lower container half has a lower retaining ridge located therealong a perimeter of a lower edge of the lower sidewall, capable of providing a removable fit with the lid assembly. Also, the lower container half has an upper retaining ridge located therealong a perimeter of an upper edge of the lower sidewall, capable of providing a removable fit with the lid assembly, which is suitable for when the fastening strip severs the upper container half from the lower container half.

In a preferred embodiment, the fastening strip has a pull tab. Differing embodiments of the fastening strip can include an adhesive, a semi-perforated section, and a pre-stressed indentation.

In another object of the present invention, the hand pump mechanism includes a suction tube extending within the container assembly such that a lower end contacts an inner surface of the lower container half lower end, and a scraping blade affixed longitudinally to an outer surface of the suction tube such that a lower end thereof contacts the lower container half lower end inner surface. In certain embodiments, the scraping blade is semi-flexible. In other embodiments, the suction tube and scraping blade are integral.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
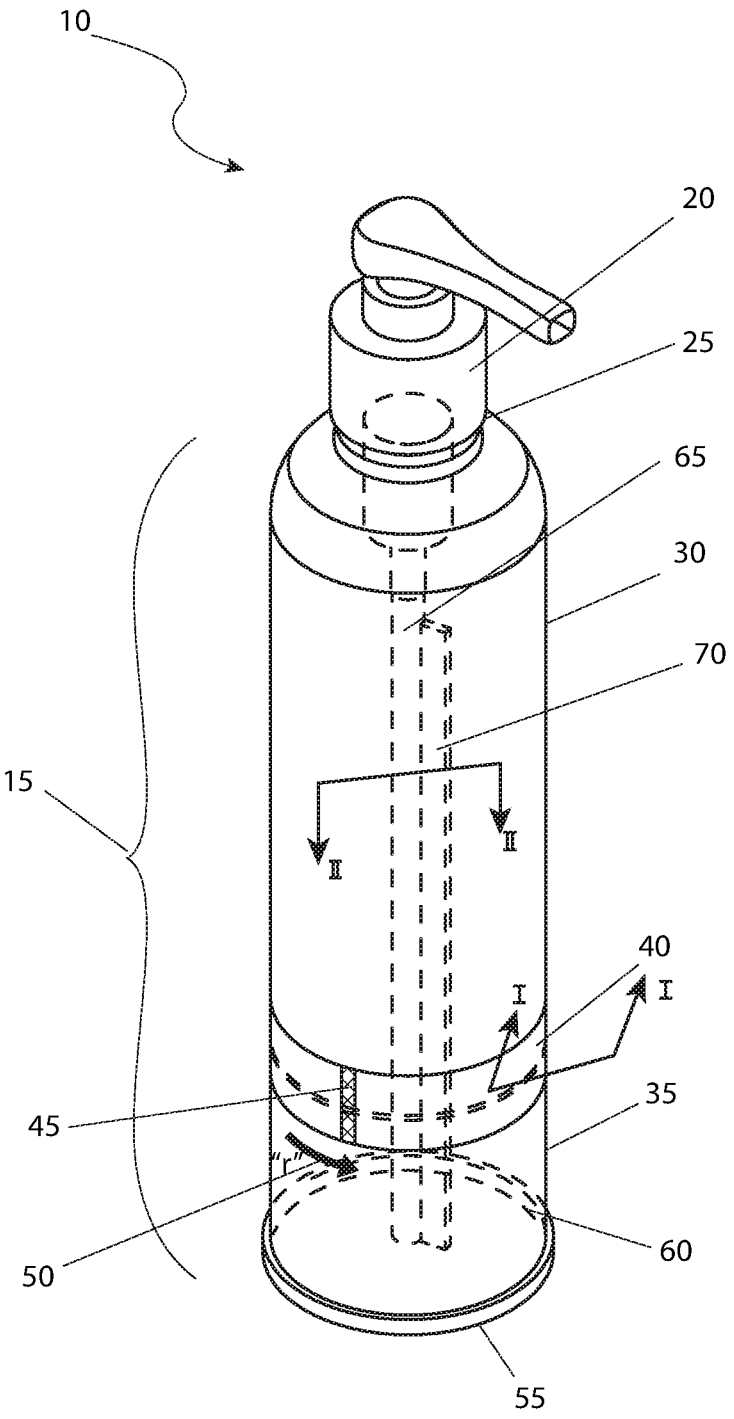
FIG. 1 is a front view of the separable hand pump bottle apparatus for viscous liquids 10, according to the preferred embodiment of the present invention.

10 separable hand pump bottle apparatus
15 bottle assembly
20 hand pump mechanism
25 threaded opening
30 upper bottle half
35 lower bottle half
40 fastening strip
45 pull tab
50 removal travel path "r"
55 lid assembly
60 lower retaining ridge
65 suction tube
70 scraping blade
75 junction point

80 upper retaining ridge
85 hollow transfer space
90 viscous liquid product

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, a front view of the separable hand pump bottle apparatus 10, according to the preferred embodiment of the present invention, is disclosed. The separable hand pump bottle apparatus 10 (herein described as the "apparatus") 10, comprises a bottle assembly 15 and a hand pump mechanism 20. The apparatus 10 is used to hold typical viscous products including but not limited to: shampoo, hair conditioner, body wash, soap, sanitizer, skin lotion, hand cream, facial cleansers, makeup products, cleaning products, wax products, finishing products, car care products or the like as are typical found in residential, commercial, and industrial environments. The hand pump mechanism 20 is attached to the bottle assembly 15 by a threaded opening 25 as is customarily expected. The hand pump mechanism 20 operates in a normal manner well known in the art. The internal components and any specific mode, method, or type of operation are not intended to be a limiting factor of the hand pump mechanism 20 nor of the apparatus 10.

The bottle assembly 15 is of a uniform cross-section for the entire height of its construction, including the base or bottom. The bottle assembly 15 includes an upper bottle half 30 and pull tab 45 joined together by fastening strip 40. Further detail on the connection between the upper bottle half 30 and the pull tab 45 will be provided herein below. The fastening strip 40 can be of an adhesive design, semi-perforated design, a pre-stressed indention or other similar method. While the balance of this description will utilize an adhesive design utilizing adhesive tape, it is not intended to be a limiting factor of the present invention and will function in an equally effective manner with other types of fastening systems. The fastening strip 40 is provided with a pull tab 45 that is grasped by the user and pulled along a removal travel path "r" 50 for the three hundred sixty degree (360°) circumference of the bottle assembly 15. Once removed, the bottle assembly 15 is separated into two (2) separate pieces, the upper bottle half 30, and the lower bottle half 35. Further description of the separation process will be provided herein below.

A lid assembly 55 is pre-positioned on the lower surface of the lower bottle half 35 during initial manufacture of the apparatus 10. It should be noted that the lower bottle half 35 is closed on the bottom and the pre-positioning of the lid assembly 55 is for storage only. The lid assembly 55 is held in place by friction fit upon a lower retaining ridge 60 (shown via hidden lines due to illustrative limitations). Further description of subsequent use of the lid assembly 55 will be provided herein below. Finally, a suction tube 65 (shown via hidden lines due to illustrative limitations) is connected to the upper bottle half 30 as would be typically expected. The suction tube 65 is provided with a scraping blade 70 (shown via hidden lines due to illustrative limitations). Further description on the use of the scraping blade 70 will be provided herein below.

Figure 2:
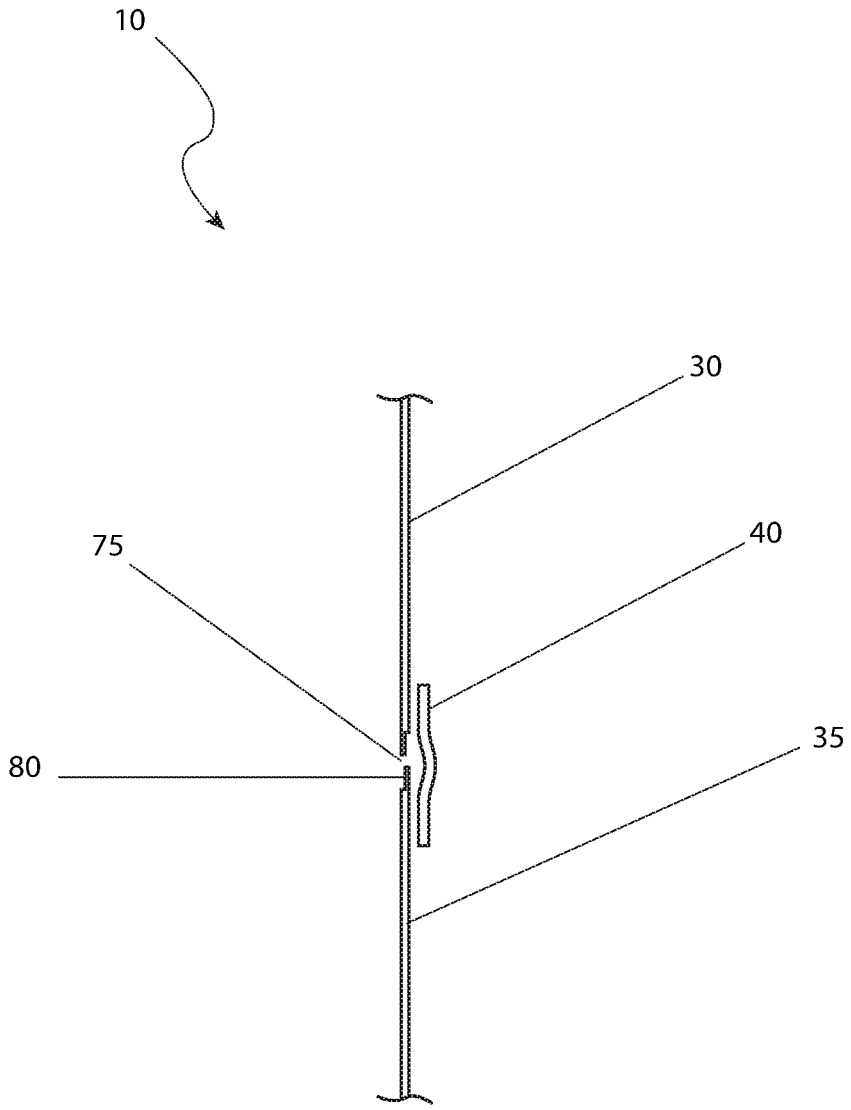
FIG. 2 is a sectional view of the separable hand pump bottle apparatus for viscous liquids 10, as seen along a line I-I, as shown in FIG. 1, according to the preferred embodiment of the present invention.

Referring next to FIG. 2, a sectional view of the apparatus 10, as seen along a line I-I, as shown in FIG. 1, according to the preferred embodiment of the present invention is depicted. This view depicts a partial portion of the upper bottle half 30 and the lower bottle half 35 arranged along a collinear axis and butt up against one (1) another at a junction point 75. They are held in place via the fastening strip 40 during initial manufacture forming a waterproof joint allowing for filling of the apparatus 10 with various viscous liquid compounds. The lower bottle half 35 is provided with an upper retaining ridge 80 for placement of the lid assembly 55 (as shown in FIG. 1). The lid assembly 55 (as shown in FIG. 1) is placed upon the upper retaining ridge 80 after the upper bottle half 30 is separated from the threaded opening 25 and the lid assembly 55 (as shown in FIG. 1) is removed from the lower retaining ridge 60 (as shown in FIG. 1). The fastening strip 40 has a pull tab 45 and is an adhesive, wherein the pull tab 45 completely covers the bottle assembly 15.

Figure 3:
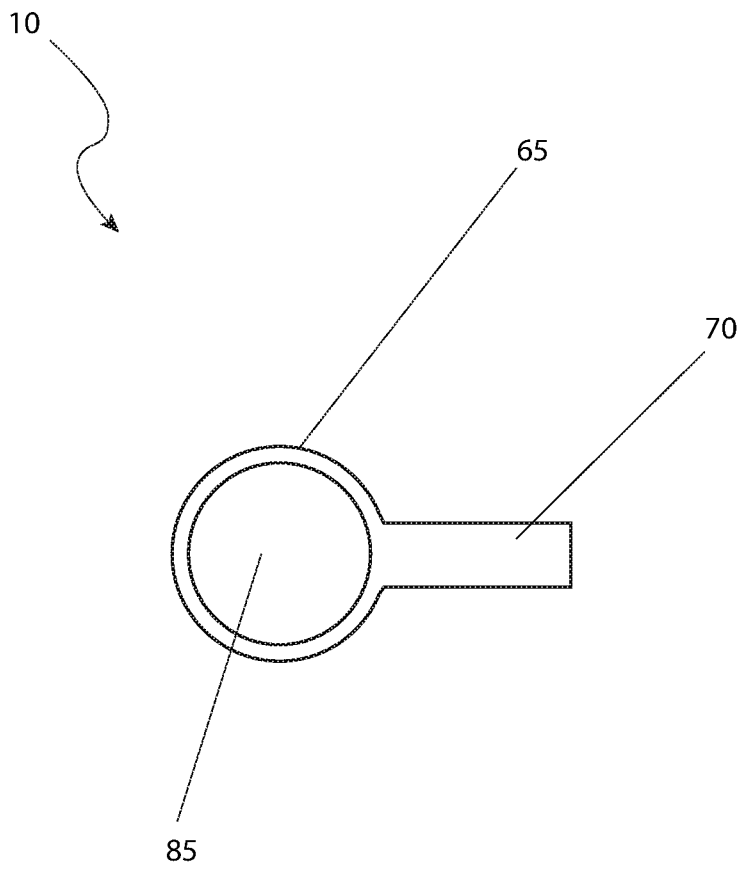
FIG. 3 is a sectional view of the separable hand pump bottle apparatus for viscous liquids 10, as seen along a line II-II, as shown in FIG. 1, according to the preferred embodiment of the present invention.

Referring now to FIG. 3, a sectional view of the apparatus 10, as seen along a line II-II, as shown in FIG. 1, according to the preferred embodiment of the present invention is shown. The suction tube 65 is provided with a hollow transfer space 85 for the conveyance of the viscous liquid product as is customarily expected. The scraping blade 70 is provided as an integral component of the suction tube 65 and is envisioned to be cast as one-piece in an extrusion molding process. The scraping blade 70 is of a semi-flexible nature allowing it to flex during a scraping procedure. Further description of the actual usage procedure will be provided herein below.

Figure 4:
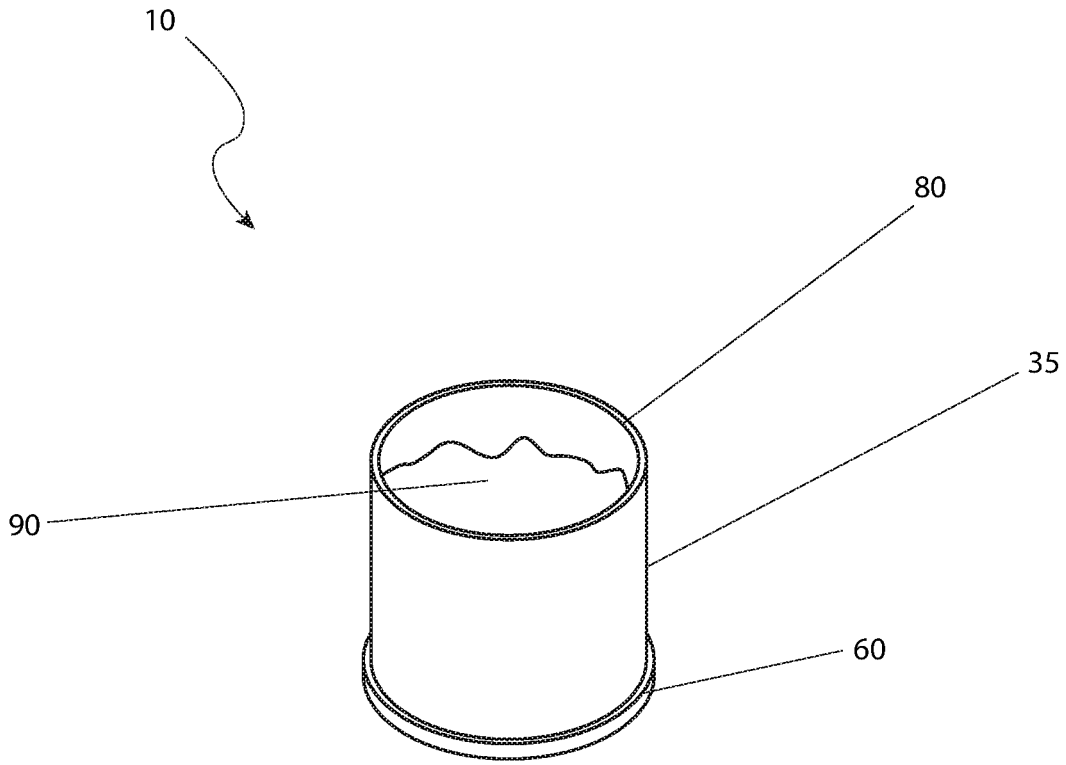
FIG. 4 is a perspective view of the lower bottle half 35 with the lid assembly 55 uninstalled, as used with the separable hand pump bottle apparatus for viscous liquids 10, according to the preferred embodiment of the present invention; and, FIG. 5 is a perspective view of the lower bottle half 35 with the lid assembly 55 installed, as used with the separable hand pump bottle apparatus for viscous liquids 10, according to the preferred embodiment of the present invention.

Referring next to FIG. 4, a perspective view of the lower bottle half 35 with the lid assembly 55 uninstalled, as used with the apparatus 10, according to the preferred embodiment of the present invention is disclosed. The lower bottle half 35 is separated from the upper bottle half 30 (as shown in FIG. 1) after usage of the apparatus 10 has allowed the viscous liquid product 90 to fall below the level of the upper retaining ridge 80. At this point in time, the lid assembly 55 (as shown in FIG. 1) is removed from the lower retaining ridge 60 thus producing a tub-like container with the remaining viscous liquid product 90 inside.

Figure 5:
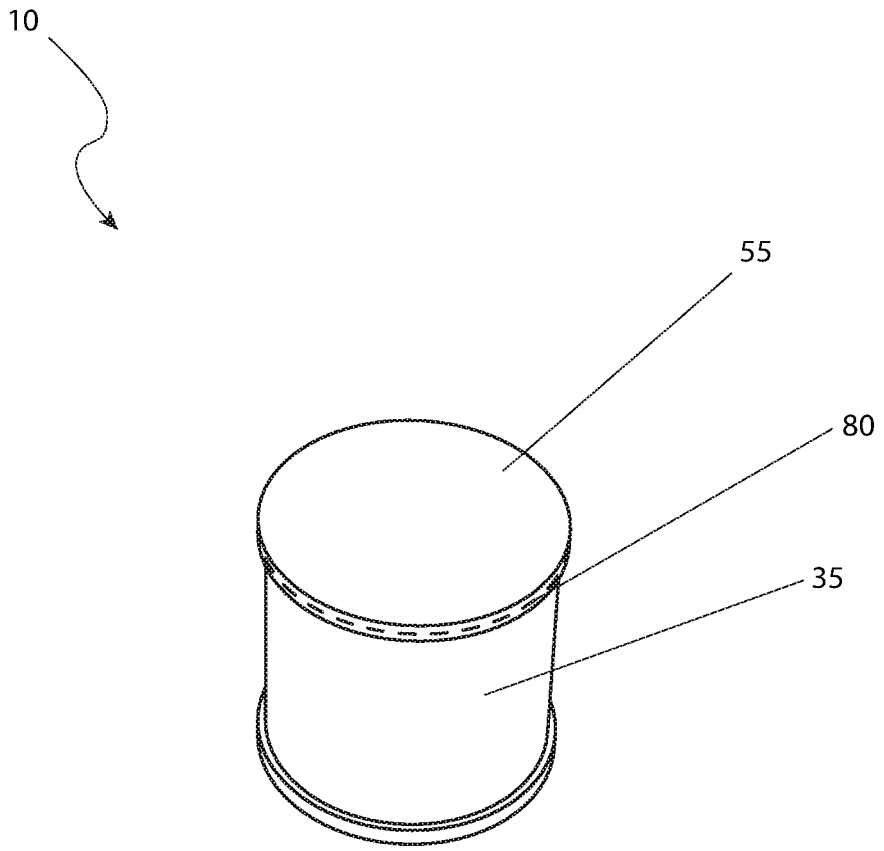

Referring finally to FIG. 5, a perspective view of the lower bottle half 35 with the lid assembly 55 installed, as used with the apparatus 10, according to the preferred embodiment of the present invention is depicted. Similar to that seen in FIG. 4, the lower bottle half 35 is separated from the upper bottle half 30 (as shown in FIG. 1) after usage of the apparatus 10 has allowed the viscous liquid product 90 (as shown in FIG. 4) to fall below the level of the upper retaining ridge 80 (as shown in FIG. 4). At this point in time, the lid assembly 55 is placed upon the upper retaining ridge 80 (shown via hidden lines due to illustrative limitations) to produce an air tight sealed container.

The preferred embodiment of the present invention can be utilized by the common user in a simple and effortless manner with little or no training. It is envisioned that the separable hand pump bottle apparatus for viscous liquids 10 would be constructed in general accordance with FIG. 1 through FIG. 5. During initial manufacture and filing, the upper bottle half 30 is placed against the lower bottle half 35 and semi-permanently attached via placement of the fastening strip 40. The lid assembly 55 is then placed upon the lower retaining ridge 60 for storage purposes. Next the bottle assembly 15 is filled with viscous liquid product 90 and the hand pump mechanism 20 with suction tube 65 is secured into the threaded opening 25. At this point in time, the apparatus 10 is ready for distribution and sale to the final user.

Upon receipt of the apparatus 10 filled with the desired viscous liquid product 90, the user would utilize the apparatus 10 in a conventional well known and transparent manner until the level of the viscous liquid product 90 within the bottle assembly 15 has fallen well below the level of the upper retaining ridge 80 and in fact until the point when the viscous liquid product 90 can no longer be easily or effectively drawn up into the suction tube 65. At this point in time, the user will separate the upper bottle half 30 from the lower bottle half 35 by removing the fastening strip 40 with the aid of the pull tab 45 along the removal travel path "r" 50. Next, the lid assembly 55 would be removed from the lower bottle half 35 and set aside for later use. Next, the hand pump mechanism 20 would be removed from the threaded opening 25 and the suction tube 65 withdrawn out of the threaded opening 25.

While holding the upper bottle half 30 in one (1) hand, the user would hold the upper part of the hand pump mechanism 20 in the other hand and use the scraping blade 70 to remove all viscous liquid product 90 that is positioned on the interior of the upper bottle half 30. As the viscous liquid product 90 is removed, it is allowed to fall into the lower bottle half 35. Once satisfactorily emptied, the upper bottle half 30, the hand pump mechanism 20, and the suction tube 65 is discard.

Finally, with all of the remaining viscous liquid product 90 stored within the lower bottle half 35, the lid assembly 55, previously set aside, can be placed atop the lower bottle half 35 and secured via the upper retaining ridge 80. This allows the user to simply remove the lid assembly 55 when accessing the viscous liquid product 90. When the viscous liquid product 90 is completely utilized, the lower bottle half 35 and the lid assembly 55 may be discarded completing the utilization procedure.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A container, comprising:

a container assembly having an upper container half, said upper container half having an upper sidewall, an open bottom, and an open top;

a lower container half having an upper end conjoined to a lower end of said upper container half with a fastening strip, a lower sidewall, and a lower bottom wall, a partial portion of an upper bottle half and a lower bottle half arranged along a collinear axis, and butt up against one another at a junction point; and, a lid assembly removably attached to a lower end of said lower container half; and, a hand pump mechanism removably attachable to said open top, comprising:

a suction tube perpendicularly extending within said container assembly such that a lower end contacts an inner surface of said lower container half lower end; and, a scraping blade affixed longitudinally along an entire interior length of an outer surface of said suction tube such that a lower end thereof contacts said lower container half lower end inner surface, wherein operation of said hand pump mechanism dispenses contents held within said container assembly; and, wherein removal of said fastening strip severs an upper container half from a lower container half, said fastening strip has a pull tab and is an adhesive, wherein said pull tab completely covers said bottle assembly.

2. The container of claim 1, wherein said container assembly has a uniform cross section.

3. The container of claim 1, wherein said lower container half has a lower retaining ridge located therealong a perimeter of a lower edge of said lower sidewall, providing a removable fit with said lid assembly.

4. The container of claim 1, wherein said lower container half has an upper retaining ridge located therealong a perimeter of an upper edge of said lower sidewall, providing a removable fit with said lid assembly.

5. The container of claim 1, wherein said fastening strip is a semi-perforated section.

6. The container of claim 1, wherein said fastening strip is a pre-stressed indentation.

7. The container of claim 1, wherein said scraping blade is semi-flexible.

8. A container, comprising:

a container assembly, having:

an upper container half, having an upper sidewall, an open bottom, and an open top;

a lower container half having an upper end conjoined to a lower end of said upper container half with a fastening strip, a lower sidewall, and a lower bottom wall, a partial portion of an upper bottle half and a lower bottle half arranged along a collinear axis, and butt up against one another at a junction point; and, a lid assembly removably attached to a lower end of said lower container half; and, a hand pump mechanism removably attachable to said open top, having:

a suction tube perpendicularly extending within said container assembly; and, a scraping blade integral with a lower end of said suction tube such that said scraping blade contacts an inner surface of said lower container half lower end, said scraping blade affixed longitudinally along an entire interior length of an outer surface of said suction tube;

wherein operation of said hand pump mechanism dispenses contents held within said container assembly; and, wherein removal of said fastening strip severs an upper container half from a lower container half, said fastening strip has a pull tab and is an adhesive, wherein said pull tab completely covers said bottle assembly.

9. The container of claim 8, wherein said container assembly has a uniform cross section.

10. The container of claim 8, wherein said lower container half has a lower retaining ridge located therealong a perimeter of a lower edge of said lower sidewall, providing a removable fit with said lid assembly.

11. The container of claim 8, wherein said lower container half has an upper retaining ridge located therealong a perimeter of an upper edge of said lower sidewall, providing a removable fit with said lid assembly.

12. The container of claim 8, wherein said fastening strip is a semi-perforated section.

13. The container of claim 8, wherein said fastening strip is a pre-stressed indentation.

14. The container of claim 8, wherein said scraping blade is semi-flexible.

* * * * *